US009382723B2

(12) United States Patent
Choi

(10) Patent No.: US 9,382,723 B2
(45) Date of Patent: Jul. 5, 2016

(54) MECHANISM FOR FOLDING AND UNFOLDING A TENT OR AWNING

(71) Applicant: Campvalley (Xiamen) Co. Ltd., Xiamen, Fujian Province (CN)

(72) Inventor: Kwan Jun Choi, Xiamen (CN)

(73) Assignee: Campvalley (Xiamen) Co. Ltd., Xiamen (CN)

( * ) Notice: Subject to any disclaimer, the term of this patent is extended or adjusted under 35 U.S.C. 154(b) by 0 days.

(21) Appl. No.: 14/221,087

(22) Filed: Mar. 20, 2014

(65) Prior Publication Data

US 2014/0202511 A1 Jul. 24, 2014

Related U.S. Application Data

(63) Continuation of application No. PCT/JP2013/075195, filed on May 6, 2013.

(30) Foreign Application Priority Data

Nov. 29, 2012 (CN) ..... 2012 2 0643180 U

(51) Int. Cl.

| | |
|---|---|
| ***E04H 15/28*** | (2006.01) |
| ***E04H 15/48*** | (2006.01) |
| ***E04H 15/32*** | (2006.01) |
| *E04H 15/46* | (2006.01) |

(52) U.S. Cl.

CPC ..... *E04H 15/28* (2013.01); *E04H 15/32* (2013.01); *E04H 15/48* (2013.01); *E04H 15/46* (2013.01)

(58) Field of Classification Search

CPC ..... E04H 15/28

USPC ..... 135/98, 135, 147

See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 1,061,547 | A | 5/1913 | Kennedy |

(Continued)

FOREIGN PATENT DOCUMENTS

| | | | |
|---|---|---|---|
| CA | 2022369 | A1 | 2/1991 |
| CN | 1076987 | A | 10/1993 |

(Continued)

OTHER PUBLICATIONS

International Search Report, PCT Application No. PCT/CN2008/073142, Jan. 22, 2009.

*Primary Examiner* — Noah Chandler Hawk

(74) *Attorney, Agent, or Firm* — Morgan, Lewis & Bockius LLP

(57) ABSTRACT

A mechanism for folding and unfolding the top of a tent includes a connecting seat, a sliding seat and an elastic telescopic part. The connecting seat is connected with a tent top rod in a pivoted mode, and the sliding seat is connected with a connecting part in a pivoted mode and moves up and down with respect to the connecting seat. The other end of the connecting part is connected onto the tent top rod in a pivoted mode. The middle portion of the connecting seat extends downwards to form an accommodating seat which accommodates the elastic telescopic part. The upper portion of the sliding seat forms a sinking seat which has an inner diameter larger than an outer diameter of the accommodating seat.

16 Claims, 6 Drawing Sheets

(56) References Cited

U.S. PATENT DOCUMENTS

| | | | | |
|---|---|---|---|---|
| 1,347,107 | A | 7/1920 | McCann | |
| 2,113,118 | A | 4/1938 | Pyatt | |
| 2,227,554 | A * | 1/1941 | Riordon | 135/19.5 |
| 2,306,706 | A | 12/1942 | Lucas | |
| 2,448,895 | A | 9/1948 | Lawrence | |
| 2,530,765 | A | 11/1950 | Greenup | |
| 2,555,220 | A | 5/1951 | Brown | |
| 2,731,972 | A | 1/1956 | Braun | |
| 2,948,287 | A | 8/1960 | Rupert | |
| 2,962,034 | A | 11/1960 | Finlayson | |
| 2,984,249 | A | 5/1961 | Sears, Jr. et al. | |
| 3,054,413 | A | 9/1962 | Eshelman | |
| 3,333,373 | A | 8/1967 | Taylor et al. | |
| 3,738,378 | A | 6/1973 | Williams | |
| 3,810,482 | A | 5/1974 | Beavers | |
| 3,929,146 | A | 12/1975 | Maiken | |
| 4,077,417 | A | 3/1978 | Beavers | |
| 4,148,332 | A | 4/1979 | Huddle | |
| 4,201,237 | A | 5/1980 | Watts et al. | |
| 4,280,521 | A | 7/1981 | Zeigler | |
| 4,285,354 | A | 8/1981 | Beavers | |
| 4,627,210 | A | 12/1986 | Beaulieu | |
| 4,637,748 | A | 1/1987 | Beavers | |
| 4,750,509 | A | 6/1988 | Kim | |
| 4,787,182 | A | 11/1988 | Serge | |
| 4,819,680 | A | 4/1989 | Beavers | |
| 4,838,003 | A | 6/1989 | Zeigler | |
| 4,941,499 | A | 7/1990 | Pelsue et al. | |
| 4,944,321 | A | 7/1990 | Moyet-Ortiz | |
| 4,971,090 | A | 11/1990 | Uhl | |
| 5,230,358 | A * | 7/1993 | Forell | 135/98 |
| 5,293,890 | A | 3/1994 | Park et al. | |
| 5,328,286 | A | 7/1994 | Lee | |
| 5,333,634 | A | 8/1994 | Taylor | |
| 5,361,794 | A | 11/1994 | Brady | |
| 5,423,341 | A | 6/1995 | Brady | |
| 2,716,993 | A | 9/1995 | Codrick | |
| 5,617,681 | A | 4/1997 | Lyons | |
| 5,628,338 | A | 5/1997 | Stumbo | |
| 5,634,483 | A | 6/1997 | Gwin | |
| 5,666,986 | A | 9/1997 | Fox | |
| 5,732,726 | A | 3/1998 | Lee | |
| 5,797,695 | A | 8/1998 | Prusmack | |
| 5,884,646 | A | 3/1999 | Ju | |
| 5,943,837 | A | 8/1999 | Esser et al. | |
| 6,021,795 | A | 2/2000 | Long et al. | |
| 6,032,430 | A | 3/2000 | Soukup | |
| 6,167,898 | B1 | 1/2001 | Larga et al. | |
| 6,286,530 | B1 | 9/2001 | Hussey | |
| 6,296,415 | B1 | 10/2001 | Johnson et al. | |
| 6,463,948 | B2 | 10/2002 | Lee | |
| 6,516,823 | B1 | 2/2003 | Gloveret al. | |
| 6,591,571 | B2 | 7/2003 | Fritsche et al. | |
| 6,604,844 | B2 | 8/2003 | Hussey | |
| 6,666,223 | B2 | 12/2003 | Price et al. | |
| 6,772,780 | B2 | 8/2004 | Price | |
| 6,776,179 | B1 | 8/2004 | Chen | |
| 6,854,476 | B1 | 2/2005 | Chai | |
| 6,868,858 | B2 | 3/2005 | Suh | |
| 6,874,519 | B2 | 4/2005 | Chiang | |
| 6,892,744 | B2 | 5/2005 | Feldpausch et al. | |
| 7,025,075 | B2 | 4/2006 | Suh | |
| 7,040,585 | B2 | 5/2006 | Cheng et al. | |
| 7,059,094 | B2 | 6/2006 | Yamawaki | |
| D544,941 | S | 6/2007 | Rogers | |
| 7,311,113 | B2 | 12/2007 | Suh | |
| 7,316,239 | B2 | 1/2008 | Yang | |
| 7,392,610 | B2 * | 7/2008 | Jedlicka et al. | 40/310 |
| RE40,544 | E | 10/2008 | Suh | |
| 7,481,235 | B2 | 1/2009 | Prusmack | |
| 7,546,845 | B2 | 6/2009 | Prusmack | |
| 7,607,447 | B1 * | 10/2009 | Han | 135/135 |
| 7,861,736 | B2 * | 1/2011 | Choi | 135/143 |
| 8,047,218 | B1 * | 11/2011 | Shin | 135/135 |
| 8,069,872 | B2 | 12/2011 | Bae | |
| 8,469,045 | B2 * | 6/2013 | Zhou | 135/135 |
| 8,485,208 | B2 | 7/2013 | Seo | |
| D705,884 | S | 5/2014 | Jin | |
| 8,910,648 | B2 | 12/2014 | Jin | |
| 2001/0050098 | A1 | 12/2001 | Lee | |
| 2003/0005953 | A1 | 1/2003 | Erbetta et al. | |
| 2006/0016467 | A1 * | 1/2006 | Bae | 135/98 |
| 2006/0289048 | A1 | 12/2006 | Choi | |
| 2007/0051399 | A1 | 3/2007 | Jung | |
| 2007/0215192 | A1 | 9/2007 | Hoffman | |
| 2013/0014794 | A1 | 1/2013 | Jin | |
| 2014/0261601 | A1 | 9/2014 | Jin | |
| 2014/0290710 | A1 | 10/2014 | Choi | |
| 2015/0083177 | A1 | 3/2015 | Hotes | |

FOREIGN PATENT DOCUMENTS

| | | | |
|---|---|---|---|
| CN | 2506736 | Y | 8/2002 |
| CN | 2635827 | Y | 8/2004 |
| CN | 2697225 | Y | 5/2005 |
| CN | 201013097 | Y | 1/2008 |
| CN | 201103269 | Y | 8/2008 |
| CN | 201129060 | Y | 10/2008 |
| FR | 1 121 851 | | 8/1956 |
| FR | 88588 | | 5/1958 |
| GB | 2201703 | A | 9/1988 |
| GB | 2259927 | A | 3/1993 |
| KR | 10-2011-0054253 | A | 5/2011 |
| WO | WO 2011/022764 | A1 | 3/2011 |

* cited by examiner

MECHANISM FOR FOLDING AND UNFOLDING A TENT OR AWNING

FIELD

The utility model relates to components for travelling and camping equipment, and particularly to a mechanism for folding and unfolding the top of a tent or awning.

BACKGROUND

Tent or awnings are among the leisure products which are ever prepared for outdoor use. However, as for a relatively large tent or awning, it is required for several persons to unfold the tent or awning successfully due to its bulky and heavy nature. Accordingly, various supporting structures have been designed to facilitate unfolding the tent or awning.

Therefore, a supporting device for supporting the top of a tent or awning was proposed which is easy to unfold, as shown in FIGS. 1-3. The supporting device comprises: a connecting seat 1' which is provided with a pivoting slot 11'; a sliding seat 2' which moves up and down with respect to the connecting seat 1'; an elastic telescopic part 3' which is arranged in the sliding seat 2'; and a fixing plate 4' which horizontally penetrates through a notch 23' of the sliding seat 2' and limits the elastic telescopic part 3'. Both ends of the fixing plate 4' are connected onto the connecting seat 1' by connecting nails 7'. Each tent top pole 5' is connected within the pivoting slot 11' in a pivoted mode respectively. A connector 6' is connected onto each tent top pole 5' in a pivoted mode respectively. The other end of the connector 6' is connected within a pivoting seat 22' at the lower portion of the sliding seat 2' in a pivoted mode. As shown in FIG. 3, generally when the tent or awning is in the folded state, each tent top pole 5' is subject to a concentrated force to lean together, and the connector 6' and the sliding seat 2' lean with each other in parallel. The sliding seat 2' is subject to a force to move down with respect to the connecting seat 1', and the fixing plate 4' moves to a position over the notch 23' of the sliding seat 2' to reduce its distance from the sliding seat 2'. In this case the elastic telescopic part 3' in the sliding seat 2' is compressed in an energy accumulation state. When it is desired to fold the tent or awning, the concentrated force acting on the tent top pole 5' is released, the sliding seat 2' will be pushed by the elastic telescopic part 3' to slide towards the connecting seat 1' along the fixing plate 4'. The upper portion of the sliding seat 2' will project outward to the upper portion of the connecting seat 1'. Due to the pivoting relationships between the connector 6' and the sliding seat 2' and tent top pole 5', when the sliding seat 2' is moving upwards, the tent top pole 5' will be pushed outward so as to realize the function of unfolding the tent or awning. When the sliding seat 2' moves upwards to a position where the fixing plate 4' rests, the tent or awning can be unfold completely.

However, such a supporting device for supporting the top of a tent suffers from some drawbacks. It is required that the fixing plate for limiting the elastic telescopic part should penetrate horizontally the sliding seat. Thus, a notch should be arranged in the sliding seat. This not only impairs the strength of the sliding seat, but also influences the integrity and aesthetics of appearance. Besides, at least two connecting nails are necessary to connect the fixing plate, and are arranged outside the sliding seat. This results in the drawbacks that there are many and diverse components and that the organization is discrete.

SUMMARY OF THE INVENTION

It is an object of the utility model to provide a mechanism for folding and unfolding the top of a tent which is concise and simple in structure, good in appearance integrality, and long in the service life.

To realize the above object, the utility model provides the following solutions: a mechanism for folding and unfolding the top of a tent, comprising: a connecting seat, a sliding seat and an elastic telescopic part, wherein the connecting seat is connected with a tent top rod in a pivoted mode, the sliding seat is connected with a connecting part in a pivoted mode and moves up and down with respect to the connecting seat, and the other end of the connecting part is connected onto the tent top rod in a pivoted mode; wherein the middle portion of the connecting seat extends downwards to form an accommodating seat which accommodates the elastic telescopic part; the upper portion of the sliding seat forms a sinking seat which has an outer diameter larger than that of the accommodating seat; a bolt rod sequentially penetrates through the sliding seat, the lower end of the accommodating seat, and the elastic telescopic part upwards from the lower portion of the sliding seat, and then is connected with a bolt nut in a locked mode.

Said elastic telescopic part is a spring or cylinder.

Said bolt nut has an outer diameter smaller than the inner diameter of the accommodating seat and larger than the outer diameter of the elastic telescopic part.

By adopting the above solutions, according to the utility model, the containing seat is arranged on the connecting seat, so that the elastic telescopic part is accommodated in the accommodating seat. By means of the bolt rod and the bolt nut, it is possible to compress the elastic telescopic part and to drive the up and down movement of the sliding seat. The sliding seat drives the tent top rod to fold and unfold by means of a connecting rod to realize the function of assisting to unfold a tent. Therefore, the mechanism for folding and unfolding the top of a tent of the utility model is concise and simple in structure, and good in appearance integrality. In addition, since it is not necessary to form a hole or slot in the sidewall of the accommodating seat which accommodates the elastic telescopic part, the strength and service life of the product can be effectively ensured.

DETAILED DESCRIPTION

Figure 1:
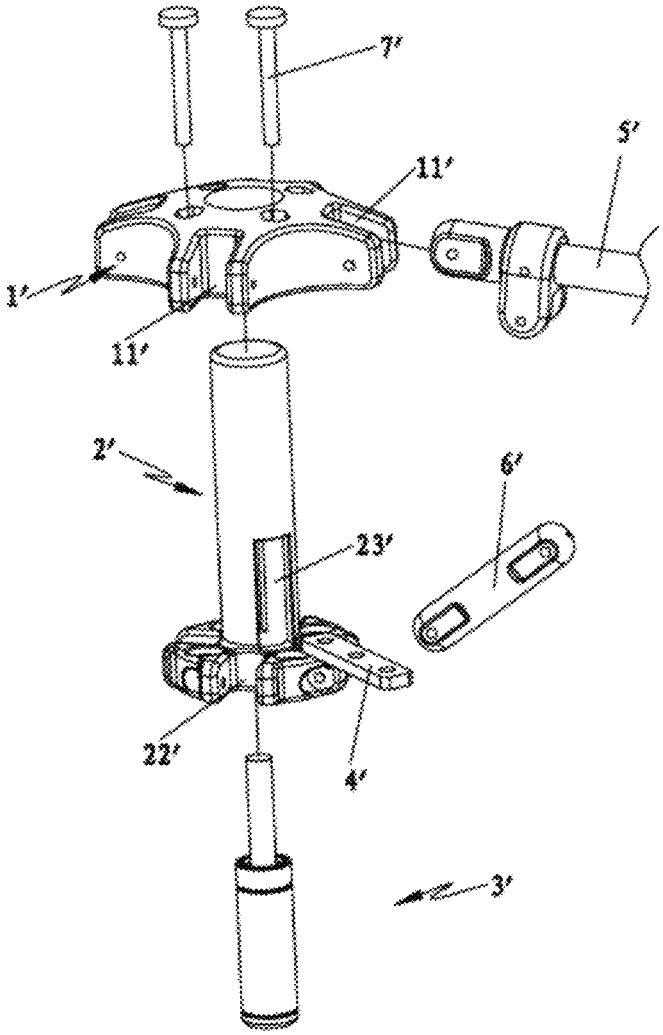
FIG. 1 (Prior Art)
FIG. 1 is an exploded perspective view for a product in the prior art.
Figure 2:
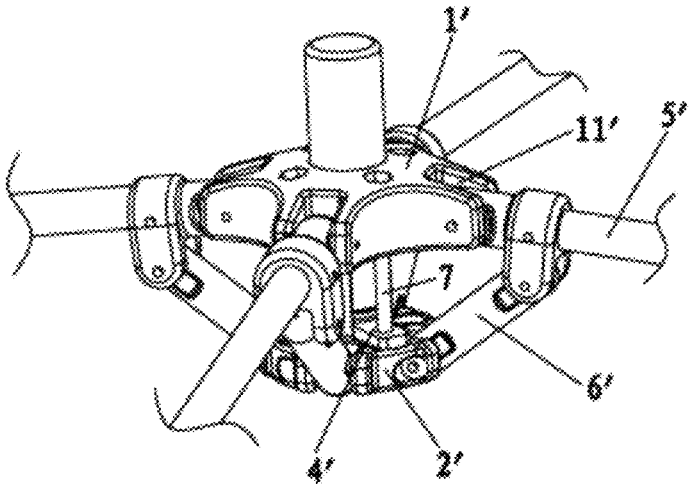
FIG. 2 (Prior Art)
FIG. 2 is a diagram showing the unfolded state for the product in the prior art.
Figure 3:
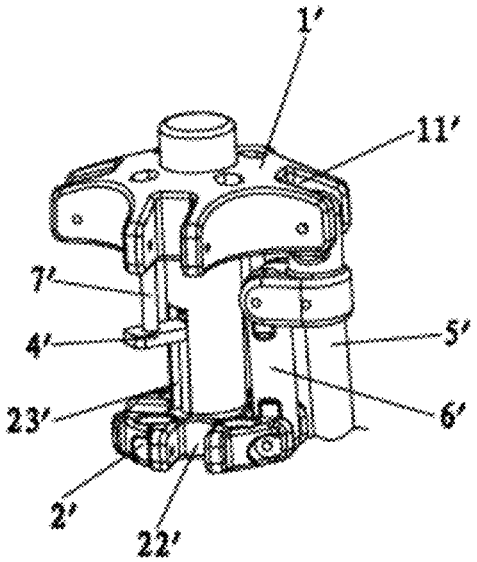
FIG. 3 (Prior Art)
FIG. 3 is a diagram showing the folded state for the product in the prior art.
Figure 4:
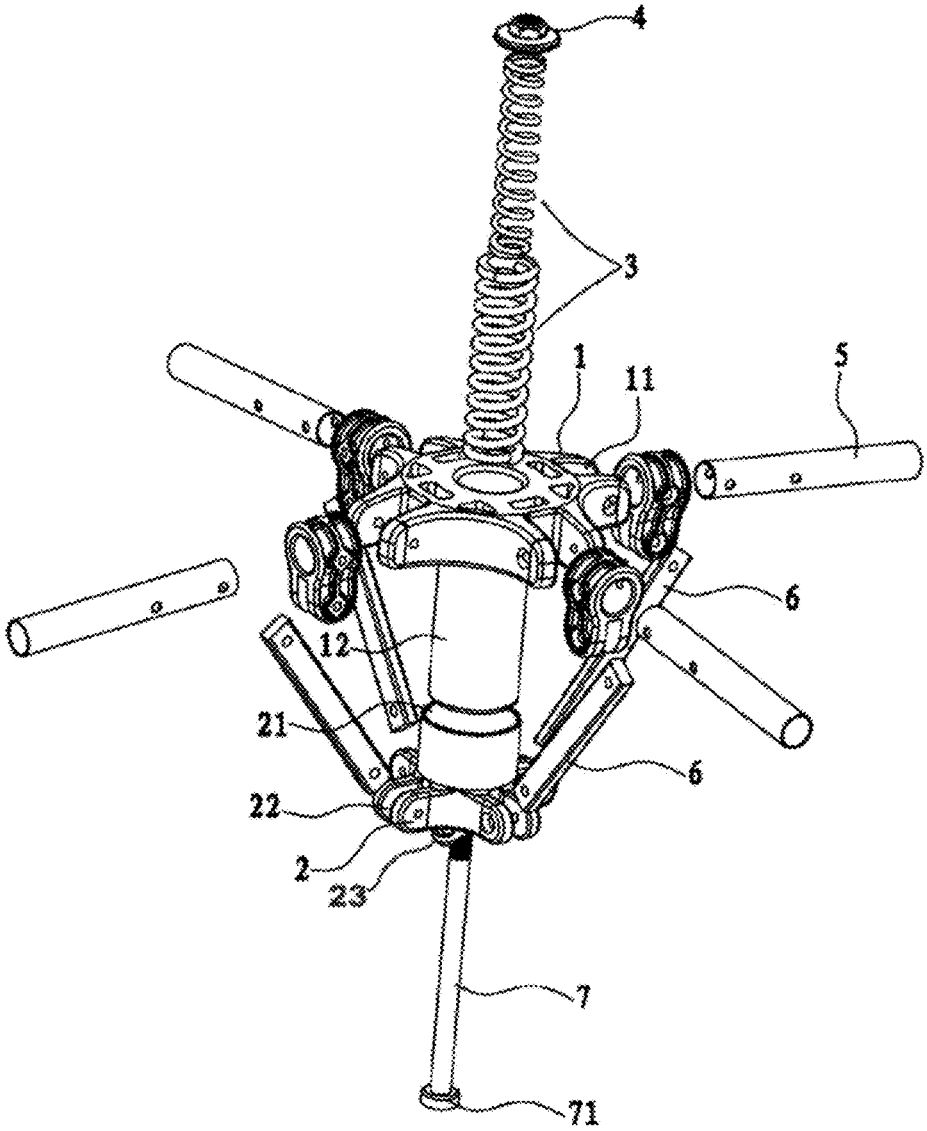
FIG. 4 is an exploded perspective view for the product of the utility model.

As shown in FIGS. 4-7A, the utility model discloses a mechanism for folding and unfolding the top of a tent, which comprises a connecting seat 1, a sliding seat 2 which is movably arranged on the connecting seat 1, and an elastic telescopic part 3.

Pivoting slots 11 are arranged evenly at the circumference of the connecting seat 1. In this embodiment, explanation is made by taking four pivoting slots 11 as an example. The pivoting slots 11 are used for connecting a tent top pole 5. A middle portion of the connecting seat 1 extends downwards to form an accommodating seat 12 for accommodating the elastic telescopic part 3. Thus, the opening of the accommodating seat 12 lies at the top end of the connecting seat 1.

The upper portion of the sliding seat 2 forms a sinking seat 21 which has an outer diameter larger than that of the accommodating seat 12. Pivoting slots 22 are also provided at the lower circumference of the sliding seat 2. These pivoting slots 22 are used for connecting in a pivoted mode, the one end of a connector 6 which supports the tent top pole 5. The other end of the connector 6 is connected with the tent top pole 5 in a pivoted mode.

The elastic telescopic part 3 may be a spring or cylinder, and is limited within the accommodating seat 12 of the connecting seat 1 by a bolt rod 7 (with head 71) in combination with a bolt nut 4. The lower end of the bolt rod 7 pushes upwards against the bolt nut 4 by an elastic force, so as to drive the bolt rod 7 to stick to the sliding seat 2.

A fixing part 23 is formed at the lower end of the sliding seat 2 for connecting the tent cloth.

As shown in the drawings, in an assembled state, the elastic telescopic part 3 is accommodated in the accommodating seat 12 of the connecting seat 1, while the sliding seat 2 sleeves the accommodating seat 12 from below the accommodating seat 12. At this time, the bolt rod 7 sequentially penetrates through the sliding seat 2, the lower end of the accommodating seat 12 and the elastic telescopic part 3 from below the sliding seat 2, and then is connected with the bolt nut 4 in a locked mode. The outer diameter of the bolt nut 4 is smaller than the inner diameter of the accommodating seat 12 and larger than the outer diameter of the elastic telescopic part 3. In this case, the elastic telescopic part 3 is limited within the accommodating seat 12 by the bolt nut 4. Then, each tent top pole 5 is connected with the connecting seat 1 and the connector 6 in a pivoted mode. The connector 6 is further connected with the sliding seat 2 in a pivoted mode, thus forming a mechanism for folding and unfolding the top of a tent.

Figure 5:
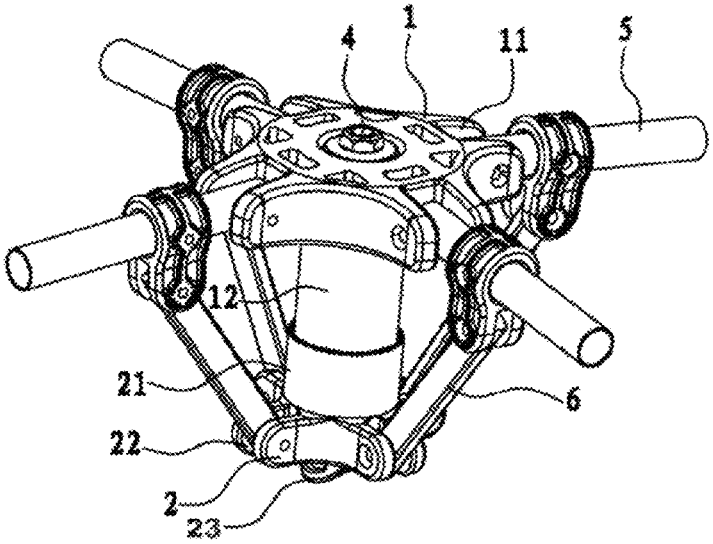
FIG. 5 is a diagram showing the unfolded state for the product of the utility model.
Figure 5A:
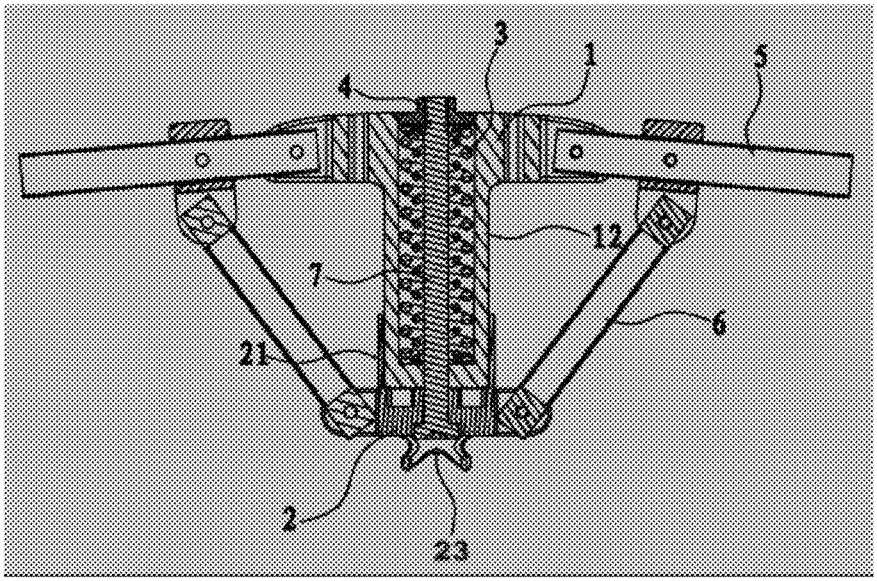
FIG. 5A is a cross sectional view of FIG. 5.

As shown in FIGS. 5 and 5A, when the elastic telescopic part 3 is in a normal state, namely, when the tent is in the unfolded state, the sinking seat 21 of the sliding seat 2 sleeves the accommodating seat 12 of the connecting seat 1. In other words, the distance between the sliding seat 2 and the connecting seat 1 is of the minimum value.

Figure 7:
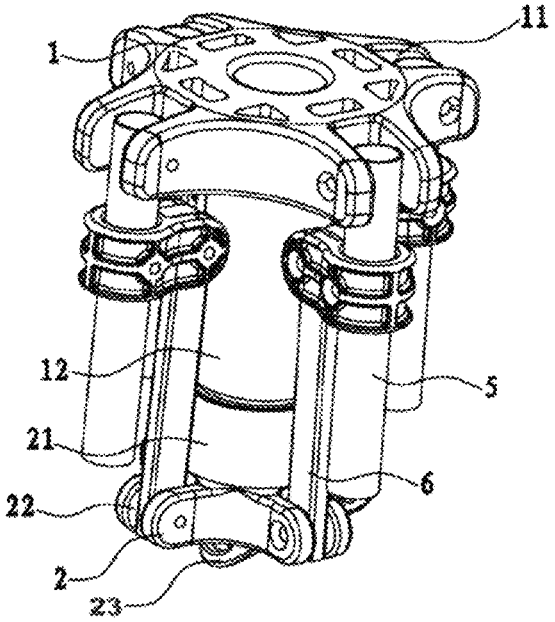
FIG. 7 is a diagram showing the folded/unfolded state for the product of the utility model.
Figure 7A:
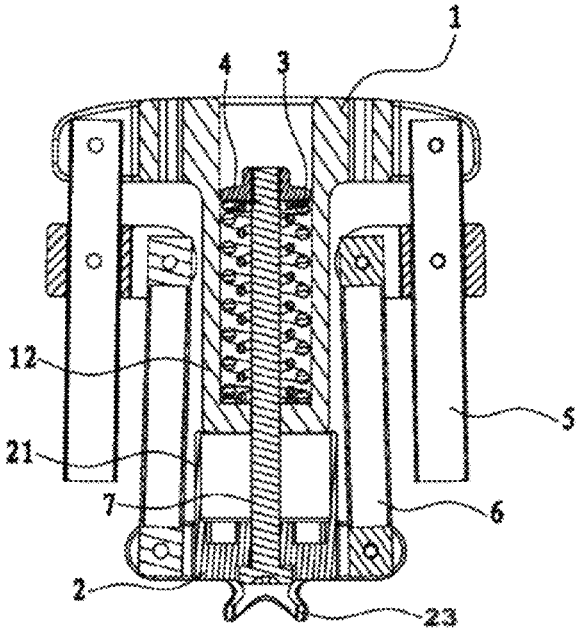
FIG. 7A is a cross sectional view of FIG. 7.

In practice, as shown in FIGS. 7 and 7A, when the tent is in the folded state, each tent top pole 5 is subject to a concentrated force to lean together, the connector 6 and the sliding seat 2 as well as the accommodating seat 12 lean with each other in parallel, while the sliding seat 2 is out of engagement with the accommodating seat 12 and is located below the accommodating seat 12. The bolt rod 7 is drawn by the sliding seat 2, and the bolt rod 7 together with the bolt nut 4 is moved downward with respect to the connecting seat 1. The elastic telescopic part 3 is pressed by the bolt nut 4 and is compressed in an energy accumulation state.

Figure 6:
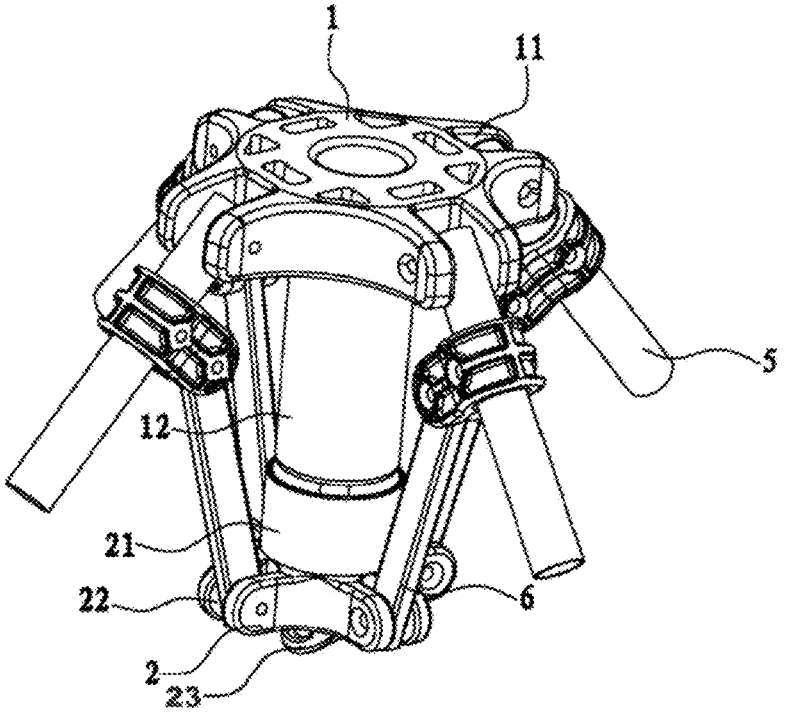
FIG. 6 is a diagram showing the folding/unfolding actions for the product of the utility model.
Figure 6A:
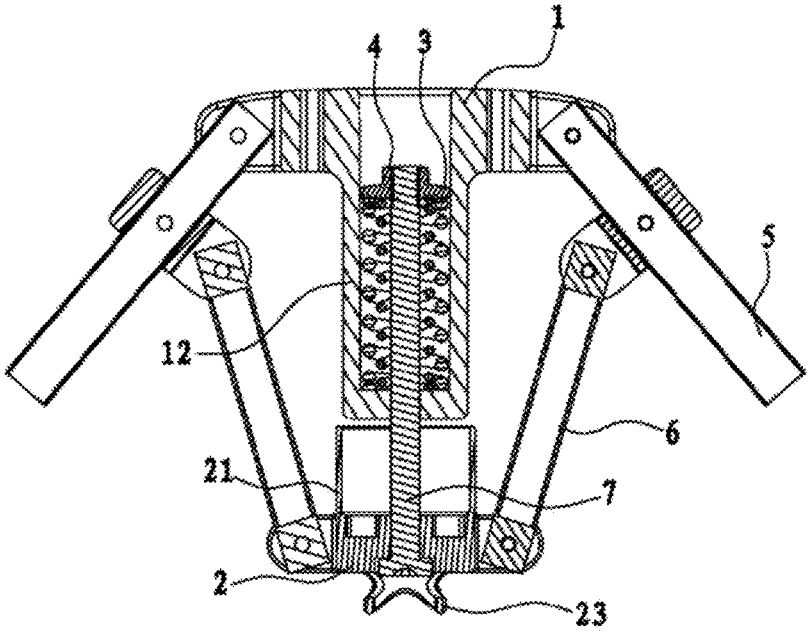
FIG. 6A is a cross sectional view of FIG. 6.

As shown in FIGS. 6 and 6A, when it is desired to unfold the tent, the concentrated force acting on the tent top pole 5 is released so that the tent top pole 5 is in a released state. Due to the restoring force of the elastic telescopic part 3, the bolt nut 4 pulls the bolt rod 7 to move upwards, and drives the sliding seat 2 to move upwards with respect to the connecting seat 1. Due to the pivoted connections between the connector 6 and the sliding seat 2 and tent top pole 5, when the sliding seat 2 moves upwards, the sliding seat 2 will push the tent top pole 5 outward to realize the function of unfolding the tent, as shown in FIGS. 5 and 5A.

In summary, in the utility model, the accommodating seat 12 is arranged over the connecting seat 1 for accommodating the elastic telescopic part 3, and the bolt rod 7 and bolt nut 4 are used for the purpose of compressing the elastic telescopic part 3 and moving the sliding seat 2 up and down. By means of the connector 6, the sliding seat 2 can further fold and unfold the tent top pole 5, thus realizing the function of assisting to unfold the tent. In this way, the utility model is more concise and simple in structure, and good in appearance integrality. Besides, since it is not necessary to form a hold or notch in the sidewall of the accommodating seat 12 which accommodates the elastic telescopic part 3, the strength and service life of the product can be effectively ensured.

What is claimed is:

1. A mechanism supporting a folded state and an unfolded state for folding and unfolding a tent or awning, wherein the tent or awning includes poles, the mechanism comprising:

a connecting seat having a top end, a middle portion, and a bottom end, wherein a plurality of first pivoting slots is formed at the top end of the connecting seat such that top surfaces of the first pivoting slots are in direct contact with a topmost surface of the connecting seat, wherein the topmost surface of the connecting seat is a topmost surface of the mechanism, an end of each of the poles is pivotally connected to a corresponding first pivoting slot, and the middle portion extends downwards to form an accommodating seat;

an elastic telescopic part disposed within the accommodating seat;

a sliding seat having a sinking seat formed at an upper portion of the sliding seat to accept the accommodating seat in the unfolded state, and a plurality of second pivoting slots formed at a bottom end of the sliding seat;

connectors each having a first end pivotally connected to a corresponding second pivoting slot formed at the bottom end of the sliding seat and a second end pivotally connected to one of the poles near the end of the corresponding pole; and a rod extending through the sliding seat, the elastic telescopic part, and the connecting seat;

wherein the sliding seat moves up and down with respect to the connecting seat.

2. The mechanism of claim 1, wherein the elastic telescopic part comprises a spring.

3. The mechanism of claim 1, the sliding seat further comprising a fixing part for connecting a tent cloth.

4. The mechanism of claim 1, wherein the rod has a rod end with an outer diameter smaller than an inner diameter of the accommodating seat and larger than an outer diameter of the elastic telescopic part.

5. The mechanism of claim 1, wherein the accommodating sink is removed from the sinking seat in the folded state.

6. The mechanism of claim 1, wherein the sinking seat is cylindrical.

7. The mechanism of claim 1, wherein the sinking seat sleeves the accommodating seat.

8. The mechanism of claim 1, wherein the elastic telescopic part drives the sliding seat toward the connecting seat to lock the mechanism in the folded state and the unfolded state.

9. A mechanism supporting a folded state and an unfolded state for folding and unfolding a tent or awning, wherein the tent or awning includes poles, the mechanism comprising:

a connecting seat having a top end, a middle portion, and a bottom end, wherein a plurality of first pivoting slots is formed at the top end of the connecting seat such that top surfaces of the first pivoting slots are in direct contact with a topmost surface of the connecting seat, an end of each of the poles is pivotally connected to a corresponding first pivoting slot, and the middle portion extends downwards to form an accommodating seat;

an elastic telescopic part disposed within the accommodating seat;

a sliding seat having a sinking seat formed at an upper portion of the sliding seat to accept the accommodating seat in the unfolded state, and a plurality of second pivoting slots formed at a bottom end of the sliding seat;

connectors each having a first end pivotally connected to a corresponding second pivoting slot formed at the bottom end of the sliding seat and a second end pivotally connected to one of the poles near the end of the corresponding pole; and a rod extending through the sliding seat, the elastic telescopic part, and the connecting seat;

wherein the sliding seat moves up and down with respect to the connecting seat, and wherein the mechanism does not include additional structure on top of the connecting seat.

10. The mechanism of claim 9, wherein the elastic telescopic part comprises a spring.

11. The mechanism of claim 9, the sliding seat further comprising a fixing part for connecting a tent cloth.

12. The mechanism of claim 9, wherein the rod has a rod end with an outer diameter smaller than an inner diameter of the accommodating seat and larger than an outer diameter of the elastic telescopic part.

13. The mechanism of claim 9, wherein the accommodating sink is removed from the sinking seat in the folded state.

14. The mechanism of claim 9, wherein the sinking seat is cylindrical.

15. The mechanism of claim 9, wherein the sinking seat sleeves the accommodating seat.

16. The mechanism of claim 9, wherein the elastic telescopic part drives the sliding seat toward the connecting seat to lock the mechanism in the folded state and the unfolded state.

* * * * *